US008353580B2

(12) United States Patent
Ito

(10) Patent No.: US 8,353,580 B2
(45) Date of Patent: Jan. 15, 2013

(54) LIQUID EJECTION HEAD

(75) Inventor: Yuichi Ito, Mei-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 112 days.

(21) Appl. No.: 13/072,058

(22) Filed: Mar. 25, 2011

(65) Prior Publication Data

US 2012/0044302 A1 Feb. 23, 2012

(30) Foreign Application Priority Data

Aug. 23, 2010 (JP) ..... 2010-185996

(51) Int. Cl.
*B41J 2/045* (2006.01)

(52) U.S. Cl. ..... 347/71

(58) Field of Classification Search ..... None
See application file for complete search history.

(56) References Cited

U.S. PATENT DOCUMENTS

| | | | | |
|---|---|---|---|---|
| 6,070,971 | A | 6/2000 | Usui | |
| 2005/0041074 | A1* | 2/2005 | Watanabe et al. | 347/71 |
| 2006/0044363 | A1* | 3/2006 | Katayama | 347/71 |
| 2006/0061633 | A1 | 3/2006 | Nakayama | |
| 2007/0195131 | A1 | 8/2007 | Katayama et al. | |
| 2008/0030553 | A1 | 2/2008 | Takahashi | |
| 2009/0002462 | A1 | 1/2009 | Okawa et al. | |

FOREIGN PATENT DOCUMENTS

| | | | |
|---|---|---|---|
| EP | 2075133 | A2 | 7/2009 |
| JP | H10-095112 | A | 4/1998 |
| JP | H11-034323 | A | 2/1999 |
| JP | 2003-211661 | A | 7/2003 |
| JP | 2006-076196 | A | 3/2006 |

OTHER PUBLICATIONS

European Patent Office, extended European Search Report for European Patent Application No. 11002371.0 (counterpart to above-captioned patent application), dated Dec. 15, 2011.

* cited by examiner

*Primary Examiner* — Matthew Luu
*Assistant Examiner* — Lisa M Solomon
(74) *Attorney, Agent, or Firm* — Baker Botts L.L.P.

(57) ABSTRACT

A liquid ejection head including: a channel unit having pressure chambers, ejection openings, and liquid channels; and an actuator unit including a piezoelectric layer and individual electrodes formed on a face of the piezoelectric layer, the actuator unit being configured to apply a drive voltage to the individual electrodes, wherein each of the individual electrodes includes: a land to which the drive voltage is applied; a main portion disposed such that an entire area thereof is opposite to a corresponding one of the pressure chambers in a direction perpendicular to the face of the piezoelectric layer; an extended portion extending, in an extending direction in which the extended portion extends, from the main portion toward the land along the face so as to connect the main portion and the land; and a dummy extended portion extending from the main portion along the face in an opposite direction opposite to the extending direction.

12 Claims, 7 Drawing Sheets

LIQUID EJECTION HEAD

CROSS REFERENCE TO RELATED APPLICATION

The present application claims priority from Japanese Patent Application No. 2010-185996, which was filed on Aug. 23, 2010, the disclosure of which is herein incorporated by reference in its entirety.

BACKGROUND OF THE INVENTION

1. Field of the Invention

The present invention relates to a liquid ejection head configured to eject liquid such as ink.

2. Description of the Related Art

There is known a liquid ejection head such as an ink-jet head configured to eject ink from ejection openings by a piezoelectric method. For example, in a conventional technique, when a voltage has been applied to one of individual electrodes (upper electrodes) formed on a face of a piezoelectric layer (a piezoelectric film), an active portion (i.e., a portion of the piezoelectric layer which is sandwiched between the individual electrode and another electrode) is displaced. As a result, a volume of a pressure chamber facing the individual electrode is changed, causing ink to be ejected from an ejection opening (i.e., a nozzle opening). The individual electrode includes a main portion and an extended portion extending from the main portion. On a face of a distal end of the extended portion in a direction in which the extended portion extends, there is formed a land (a contact) which is bonded to a terminal of an electricity supplying member (e.g., a flexible printed circuit (FPC)).

SUMMARY OF THE INVENTION

Meanwhile, in some cases, the individual electrode is formed at a position deviated or misaligned from a desired position. For example, in the case of the above-described technique, where the individual electrode has been misaligned in the direction in which the extended portion extends (i.e., in a direction from the individual electrode toward the land), a volume of the active portion is reduced. On the other hand, where the individual electrode has been misaligned in a direction opposite to the direction in which the extended portion extends (i.e., in a direction from the land toward the individual electrode), the extended portion suppresses the reduction of the volume of the active portion when compared to the case where the individual electrode has been misaligned in the direction in which the extended portion extends. Where the volume of the active portion has been reduced, problems may arise such as reduction in an ejection speed and a size of an ink droplet, for example.

It is noted that the plurality of the individual electrodes on the piezoelectric layer are generally formed at the same time for workability. Here, if directions in which the extended portions respectively extend are the same as each other for all the individual electrodes on the piezoelectric layer, even where the individual electrodes have been misaligned in any direction, volume reduction rates of the respective active portions (i.e., a rate of a volume reduction of each active portion due to the positional misalignment, with respect to a volume of each active portion in a case where the individual electrodes have not been misaligned) are the same as each other. Thus, in this case, for all the individual electrodes, degrees of effects on ink ejection property (e.g., the ejection speed, an ejecting direction, and the size of the ink droplet) due to the positional misalignment are the same as each other. Accordingly, it is possible to suppress the deterioration of the recording quality by adjusting the voltage of the electricity supplying member, for example. However, in a case where there are individual electrodes having extended portions extending in one of opposite directions and extended portions extending in the other of the opposite directions as the plurality of the individual electrodes on the piezoelectric layer, if one individual electrode has been misaligned in a direction the extended portion extends or a direction opposite thereto, volume decrease rates of active portions may be disadvantageously different from each other between the individual electrodes having the extended portions extending in the opposite directions. Consequently, in this case, the degrees of the effects on ink ejection property due to the positional misalignment are different from each other among the plurality of the individual electrodes on the piezoelectric layer. Thus, even where the above-described adjustment has been performed, it is impossible to sufficiently suppress the deterioration of the recording quality.

This invention has been developed in view of the above-described situations, and it is an object of the present invention to provide a liquid ejection head which can suppress a deterioration of a recording quality where a plurality of individual electrodes on a piezoelectric layer have extended portions extending in opposite directions and where the individual electrodes have been misaligned in a direction the extended portion extends or in a direction opposite thereto.

The object indicated above may be achieved according to the present invention which provides a liquid ejection head comprising: a channel unit having a plurality of pressure chambers, a plurality of ejection openings, and a plurality of liquid channels formed therein, the liquid channels respectively extending from the pressure chambers to the ejection openings; and an actuator unit including a piezoelectric layer and a plurality of individual electrodes formed on a face of the piezoelectric layer, the actuator unit being configured to apply a drive voltage to the individual electrodes to change volumes of the respective pressure chambers respectively corresponding to the individual electrodes, wherein each of the individual electrodes includes: a land to which the drive voltage is applied; a main portion disposed such that an entire area thereof is opposite to a corresponding one of the pressure chambers in a direction perpendicular to the face of the piezoelectric layer; an extended portion extending, in an extending direction in which the extended portion extends, from the main portion toward the land along the face of the piezoelectric layer so as to connect the main portion and the land to each other; and a dummy extended portion extending from the main portion along the face of the piezoelectric layer in an opposite direction opposite to the extending direction.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Figure 1:
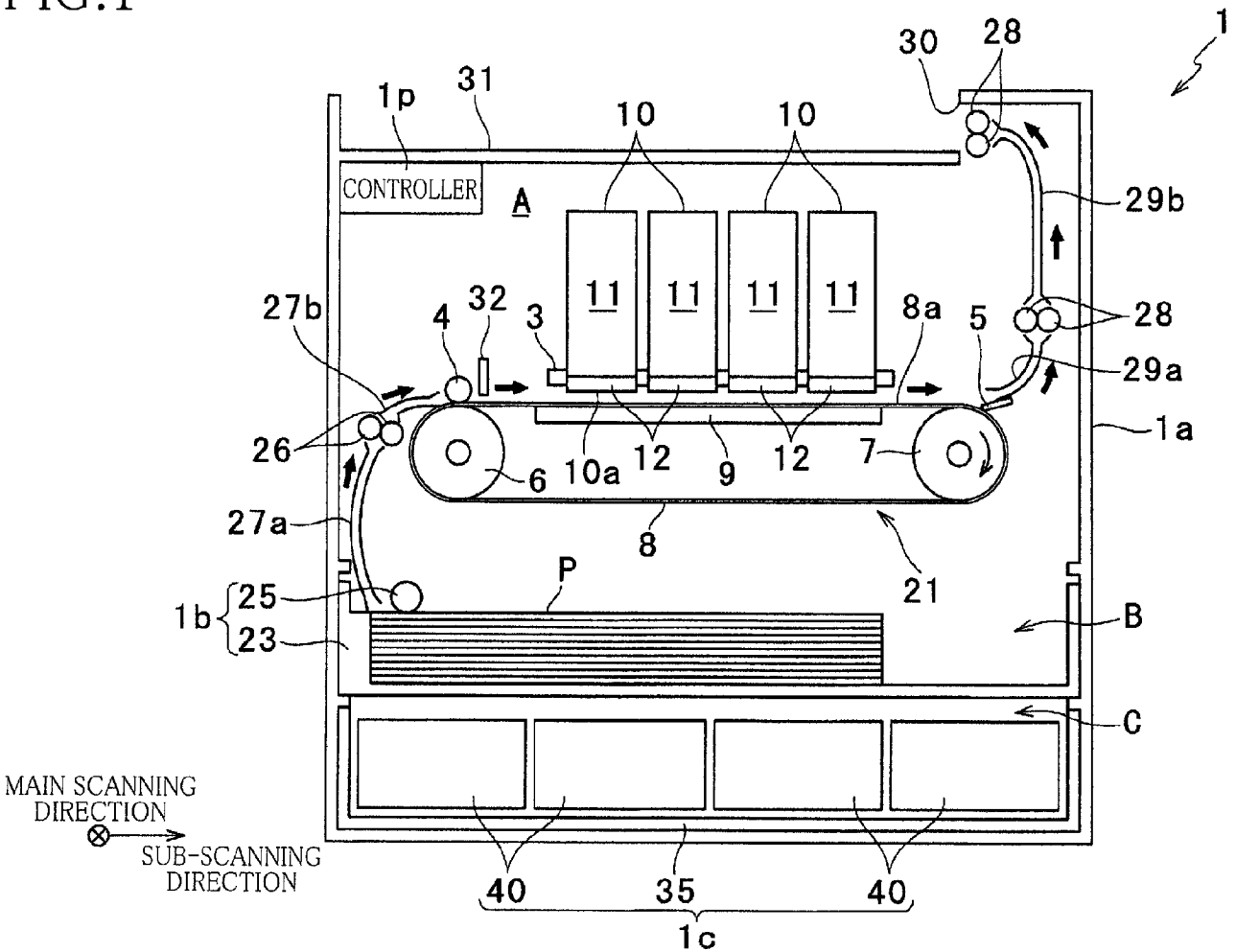
FIG. 1 is a side view generally showing an internal structure of an ink-jet printer including ink-jet heads each as an embodiment of the present invention.

Hereinafter, there will be described an embodiment of the present invention by reference to the drawings.

First, there will be explained, with reference to FIG. 1, an overall construction of an ink-jet printer including ink jet heads 10 each as an embodiment of the present invention.

The printer 1 includes a casing 1*a* having a rectangular parallelepiped shape. A sheet-discharge portion 31 is provided on a top plate of the casing 1*a*. An inner space of the casing 1*a* is divided into spaces A, B, C in order from an upper side thereof. In the spaces A, B is formed a sheet feeding path which is continuous to the sheet-discharge portion 31. In the space A, the printer 1 performs feeding or conveying of a recording medium such as a sheet P and records or forms an image on the sheet P. In the space B, the printer 1 performs an operation for supplying the sheet P. In the space C are accommodated cartridges 40 each as an ink supply source.

In the space A, there are arranged the four ink-jet heads 10, a sheet-feed unit 21 for feeding the sheet P, a guide unit (which will be described below) for guiding the sheet P, and so on. In an upper portion of the space A, there is disposed a controller 1*p* configured to control operations of components of the printer 1 to control an overall operation of the printer 1.

In order to record an image on the sheet P on the basis of image data supplied from an external device, the controller 1*p* controls: a preliminary operation for the recording; the supplying, feeding, and discharging of the sheet P; an ink ejection operation synchronized with the feeding of the sheet P; a maintenance operation for recovering or maintaining an ejection property; and so on.

The controller 1*p* includes a Central Processing Unit (CPU), a Read Only Memory (ROM), a Random Access Memory (RAM) such as a nonvolatile RAM, an Application Specific Integrated Circuit (ASIC), an interface (I/F), an Input/Output Port (I/O), and so on. The ROM stores therein programs executed by the CPU, various fixed data, and so on. The RAM temporarily stores therein data (such as image data) required for the execution of the programs. The ASIC performs, e.g., rewriting and sorting of the image data, a signal processing, an image processing, and so on. The I/F transmits or receives data to or from the external device. The I/O inputs or outputs detection signals of various sensors.

Each of the heads 10 is a line head having a generally rectangular parallelepiped shape elongated in a main scanning direction in which each head reciprocates. The four heads 10 are arranged at predetermined pitches in a sub-scanning direction and supported by the casing 1*a* via a head frame 3. Each head 10 includes a channel unit 12, eight actuator units 17 (see FIG. 2), and a reservoir unit 11. In the image recording, the heads 10 respectively eject inks of respective four colors, namely, black (K), magenta (M), cyan (C), and yellow (Y), from lower faces of the respective heads 10*a* (ejection faces 10*a*). The construction of each head 10 will be explained in greater detail below.

As shown in FIG. 1, the sheet-feed unit 21 includes (a) belt rollers 6, 7, (b) an endless sheet feeding belt 8 wound around the rollers 6, 7, (c) a nip roller 4 and a peeling plate 5 respectively disposed on opposite sides (outsides) of the sheet feeding belt 8, a platen 9 disposed inside the sheet feeding belt 8, and so on.

The belt roller 7 is a drive roller which is rotated in a clockwise direction in FIG. 1 by a sheet-feed motor, not shown. The sheet feeding belt 8 runs or is circulated along bold arrow in FIG. 1 in accordance with the rotation of the belt roller 7. The belt roller 6 is a driven roller which is rotated in the clockwise direction in FIG. 1 in accordance with the circulation of the sheet feeding belt 8. The nip roller 4 is disposed so as to face the belt roller 6 and press, onto an outer circumferential face 8*a* of the sheet feeding belt 8, the sheet P fed from an upstream guide portion which will be described below. The peeling plate 5 is disposed so as to face the belt roller 7 and peel the sheet P from the outer circumferential face 8*a* and guide the sheet P to a downstream guide portion which will be described below. The platen 9 is disposed so as to face the four heads 2 and support an upper portion of the sheet feeding belt 8 from an inside thereof. As a result, a space suitable for the image recording is formed between the outer circumferential face 8*a* and the ejection faces 10*a* of the respective heads 10.

The guide unit includes the upstream guide portion and the downstream guide portion disposed with the sheet-feed unit 21 interposed therebetween. The upstream guide portion includes guides 27*a*, 27*b* and a feed-roller pair 26 and connects a sheet-supply unit 1*b* (which will be described below) and the sheet-feed unit 21 to each other. The downstream guide portion includes guides 29*a*, 29*b* and feed-roller pairs 28 and connects the sheet-feed unit 21 and the sheet-discharge portion 31 to each other.

In the space B is disposed the sheet-supply unit 1*b* including a sheet-supply tray 23 and a sheet-supply roller 25. The sheet-supply tray 23 is mountable on and removable from the casing 1*a*. The sheet-supply tray 23 has a box-like shape opening upward so as to accommodate various sizes of sheets P. The sheet-supply roller 25 supplies an uppermost one of the sheets P in the sheet-supply tray 23 to the upstream guide portion.

As described above, in the spaces A, B is formed the sheet feeding path extending from the sheet-supply unit 1*b* to the sheet-discharge portion 31 via the sheet-feed unit 21. On the basis of a recording command, the controller 1*p* drives a plurality of motors such as a sheet-supply motor, not shown, for the sheet-supply roller 25, a sheet-feed motor, not shown, for the sheet-feed rollers of each of the upstream and downstream guide portions, the above-described sheet-feed motor, and the like. The sheet P supplied from the sheet-supply tray 23 is supplied to the sheet-feed unit 21 by the feed-roller pair 26. When the sheet P passes through positions just under the heads 10 in the sub-scanning direction, the heads 10 eject the inks of the respective four colors in order from the respective ejection faces 10*a*, to record a color image on the sheet P. The ink ejection is performed on the basis of a detection signal outputted from a sheet sensor 32. The sheet P is then peeled by the peeling plate 5 and fed upward by the feed-roller pairs 28. The sheet P is then discharged onto the sheet-discharge portion 31 through an opening 30.

Here, the sub-scanning direction is a direction parallel to the sheet feeding direction in which the sheet P is fed by the sheet-feed unit 21 and along a horizontal plane, and the main scanning direction is a direction perpendicular to the sub-scanning direction and along the horizontal plane.

In the space C, an ink unit 1*c* is disposed so as to be mountable on and removable from the casing 1*a*. The ink unit 1*c* includes a cartridge tray 35 and the four cartridges 40 accommodated in the tray 35 side by side. The inks stored in the respective cartridges 40 are supplied to the respective heads 10 via respective ink tubes, not shown.

There will be next explained the construction of each head 10 with reference to FIGS. 2-5 in detail. It is noted that, in FIG. 3, pressure chambers 16 and apertures 15 are illustrated by solid lines for easier understanding purposes though these elements are located under the actuator units 17 and thus should be illustrated by broken lines. It is further noted that, since the four heads 10 have the same construction, the following explanation will be given for one of the heads 10 for the sake of simplicity.

Figure 5:
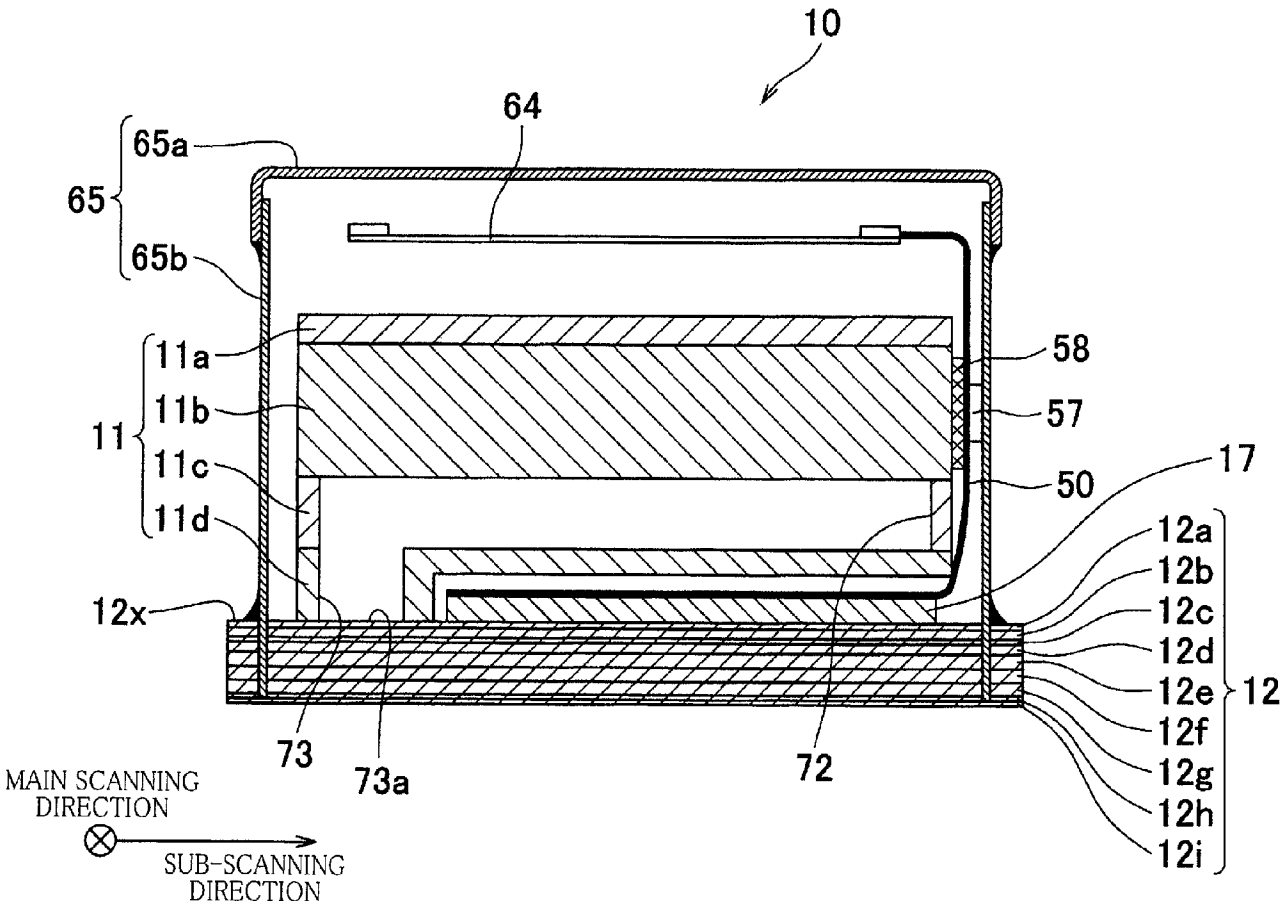
FIG. 5 is an elevational view in vertical cross section showing the ink jet head.

As shown in FIG. 5, the head 10 is a laminar body in which the channel unit 12, the actuator units 17, the reservoir unit 11, and a printed circuit 64 are stacked or laminated on one another. The actuator units 17, the reservoir unit 11, and the printed circuit 64 are accommodated in a space defined by an upper face 12*x* of the channel unit 12 and a cover 65. In this space, Flexible Printed Circuits (FPCs) 50 electrically connect the respective actuator units 17 and the printed circuit 64. Driver ICs 57 are respectively mounted on the FPCs 50.

As shown in FIG. 5, the cover 65 includes a top cover 65*a* and an aluminum side cover 65*a*. The cover 65 is a box opening downward and fixed to the upper face 12*x* of the channel unit 12. The driver ICs 57 are held in contact with an inner face of the side cover 65*a* so as to be thermally connected to the cover 65*b*. It is noted that, in order for a reliable thermal connection, the driver ICs 57 are urged toward the side cover 65*a* by an elastic member 58 such as a sponge fixed to a side face of the reservoir unit 11.

The reservoir unit 11 is a laminar body constituted by four metal plates 11*a*-11*d* bonded to one another. In the reservoir unit 11 is formed an ink channel including a reservoir 72 for string the ink. The ink channel has: one end connected to the corresponding cartridge 40 via the corresponding tube; and the other end connected to the channel unit 12. As shown in FIG. 5, a projection and a recess are formed on and in a lower face of the plate 11*d* such that the recess forms a space between the plate 11*d* and the upper face 12*x*. Each actuator unit 17 is fixed to the upper face 12*x* in the space, with a small clearance formed over the corresponding FPC 50. The plate 11*d* has an ink outlet channel 73 formed therein. The ink outlet channel 73 is opened in a distal end face of the projection formed on the lower face of the plate 11*d*, that is, the ink outlet channel 73 is opened in a face of the plate 11*d* which is bonded to the upper face 12*x*.

Figure 2:
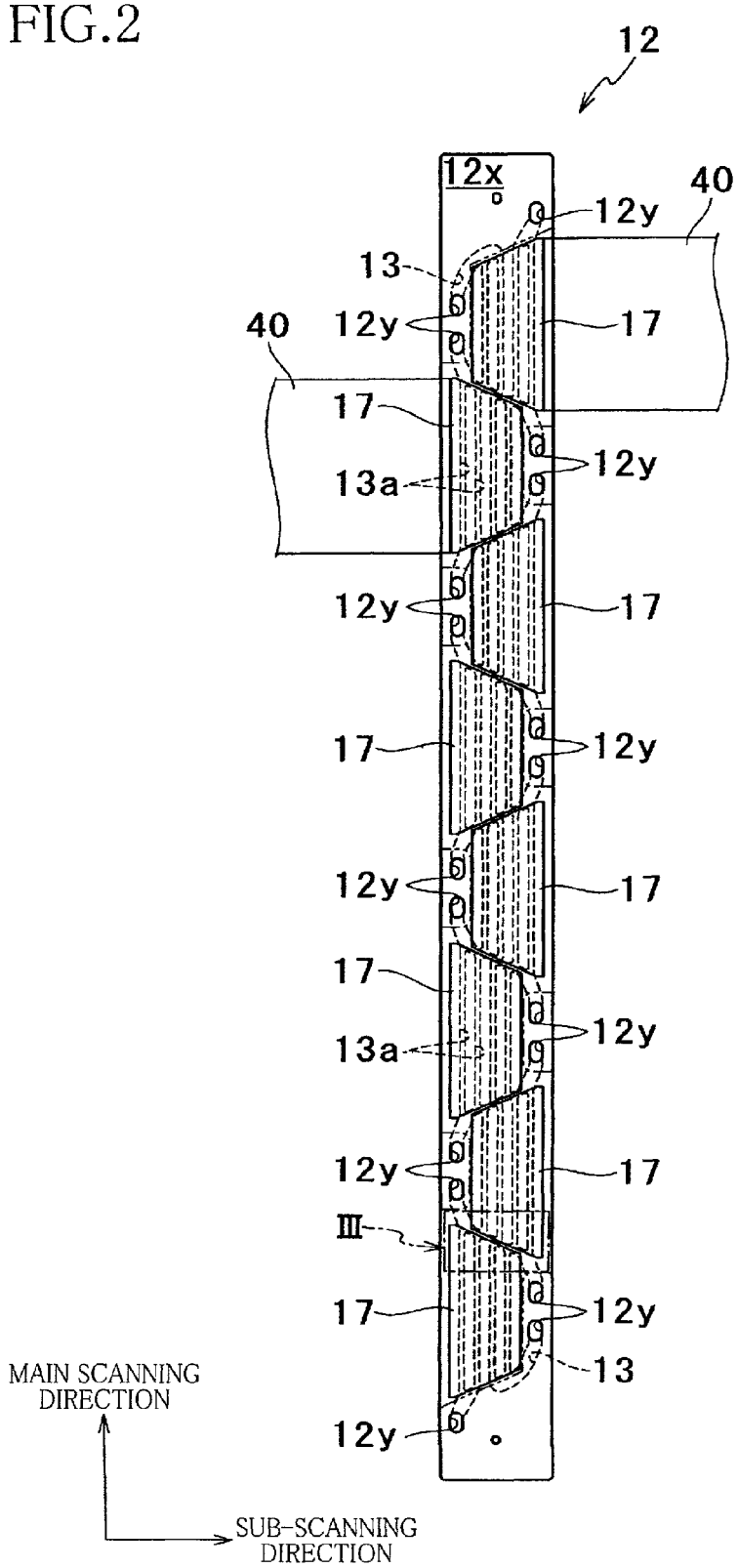
FIG. 2 is a plan view showing a channel unit and actuator units of each ink-jet head.
Figure 3:
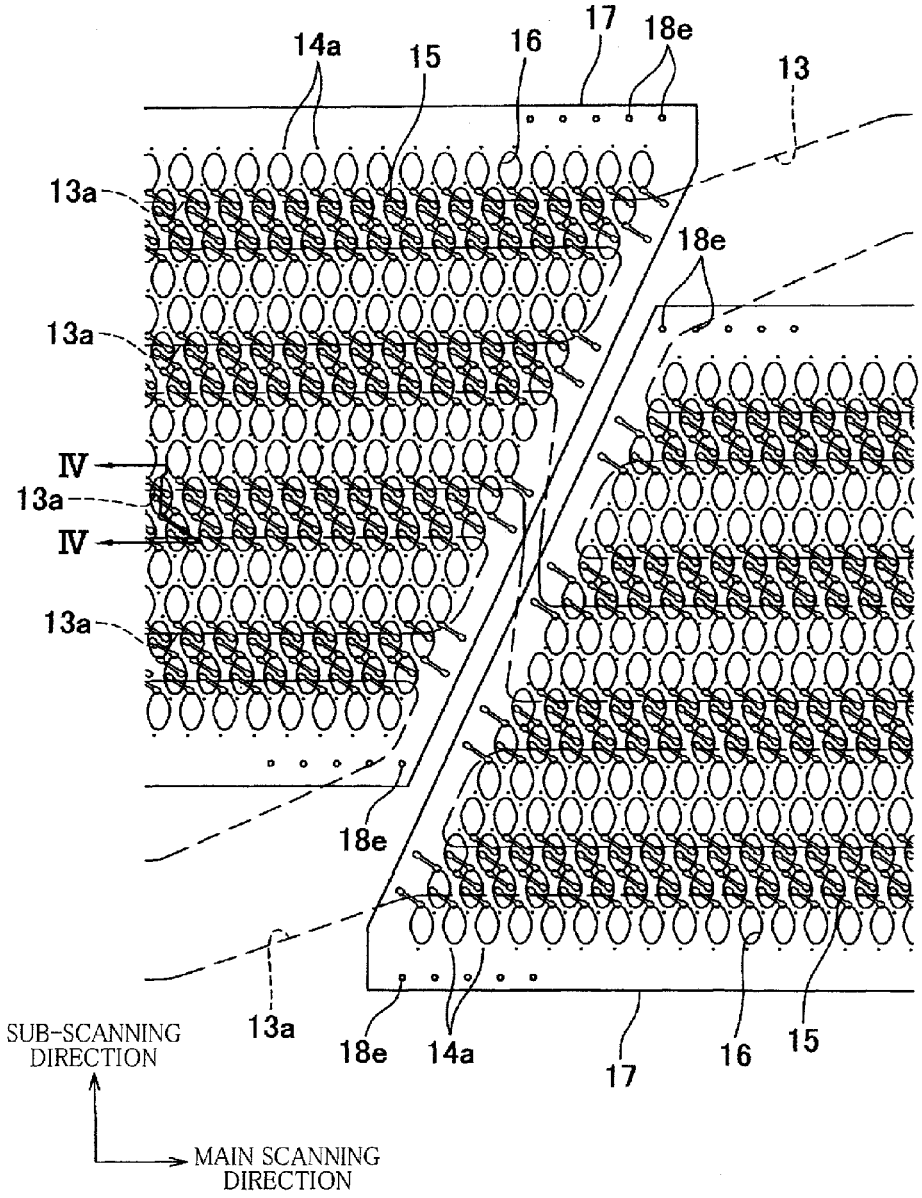
FIG. 3 is an enlarged view showing an area III enclosed by one-dot chain line in FIG. 2.
Figure 4:
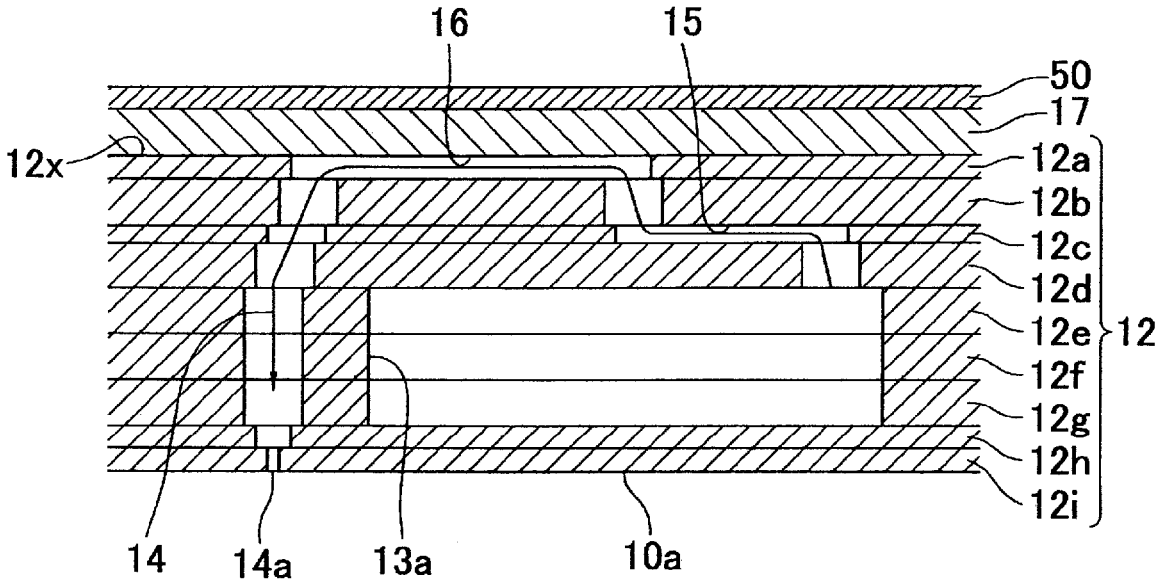
FIG. 4 is a partial cross-sectional view taken along line IV-IV in FIG. 3.

The channel unit 12 is a laminar body constituted by nine metal rectangular plates 12*a*-12*i* (see FIG. 4) having generally the same size and bonded to one another. As shown in FIG. 2, openings 12*y* are formed in the upper face 12*x* of the channel unit 12 so as to be respectively connected to openings 73*a* of the ink outlet channel 73. In the channel unit 12, there are formed ink channels each from one of the openings 12*y* to one of ejection openings 14*a*. As shown in FIGS. 2, 3, and 4, the ink channels include (a) manifold channels 13 respectively having the openings 12*y* at respective one ends, (b) sub-manifold channels 13*a* each branched from a corresponding one of the manifold channels 13, and (c) individual channels 14 (each as one example of a liquid channel) each extending from an outlet of a corresponding one of the sub-manifold channels 13*a* to a corresponding one of the ejection openings 14*a* via a corresponding one of the pressure chambers 16.

As shown in FIG. 4, the individual channel 14 is formed for each ejection opening 14*a* so as to have (a) an aperture 15 functioning as a restrictor for adjusting a channel resistance and (b) a pressure chamber 16 opened in the upper face 12*x*. As shown in FIG. 3, each pressure chamber 16 has a generally rhombic shape, and the pressure chambers 16 are arranged in the upper face 12*x* in matrix so as to form eight pressure chamber groups each having a generally trapezoid shape in plan view. Likewise, the ejection openings 14*a* are arranged in the ejection face 10*a* in matrix so as to form eight ejection opening groups each having a generally trapezoid shape in plan view.

As shown in FIG. 2, the actuator units 17 each has a trapezoid shape and are arranged on the upper face 12*x* in two arrays in a staggered configuration. As shown in FIG. 3, each of the actuator units 17 is disposed on an area corresponding to the trapezoid shape of a corresponding one of the pressure chamber groups (the ejection opening groups).

The FPC 50 is provided for each actuator unit 17. The FPC 50 has a wire and a terminal corresponding to each electrode of the actuator unit 17. The wire is connected to an output terminal of the driver IC 57. The controller 1*p* (see FIG. 1) controls the FPC 50 to transmit data adjusted by the printed circuit 64 to the driver IC 57 and to transmit drive signals produced by the driver IC 57 to each electrode of the actuator units 17. The drive signals are selectively applied to the electrodes.

Figure 6A:
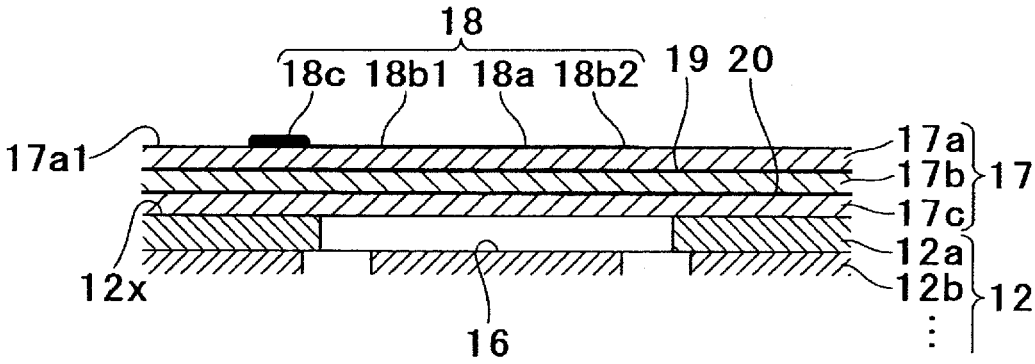
FIG. 6A is a partial cross-sectional view of the actuator unit.
Figure 6B:
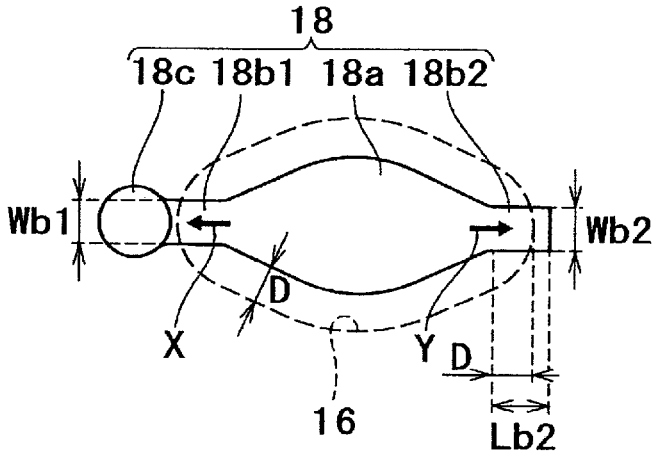
FIG. 6B is a partial plan view of the actuator unit.
Figure 7:
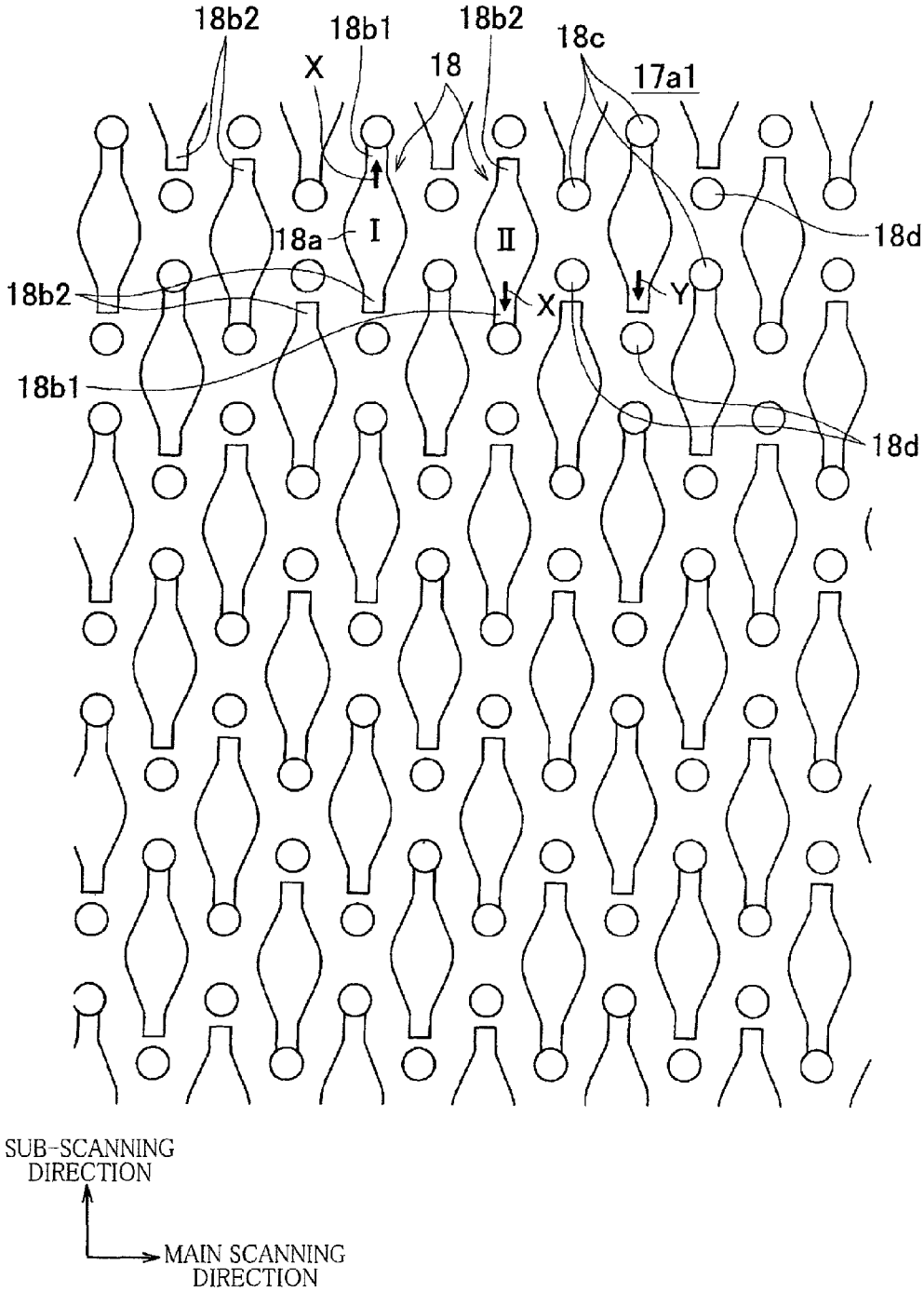
FIG. 7 is a partial plan view of the actuator unit, showing an arrangement of a plurality of individual electrodes and dummy lands.

There will be next explained a construction of each actuator unit 17 with reference to FIGS. 6A, 6B, and 7. It is noted that the following explanation will be given for one actuator unit 17 for the sake of simplicity.

As shown in FIG. 6A, the actuator unit 17 includes a laminar body constituted by three piezoelectric layers 17*a*, 17*b*, 17*c*. These piezoelectric layers 17*a*, 17*b*, 17*c* are stacked on one another in order from an upper side thereof. Each of the piezoelectric layers 17*a*, 17*b*, 17*c* is a sheet member formed of a ceramic material of lead zirconate titanate (PZT) having ferroelectricity. The piezoelectric layer 17*a* is polarized in a direction coinciding with a direction in which the piezoelectric layers 17*a*, 17*b*, 17*c* are stacked.

The piezoelectric layers 17*a*, 17*b*, 17*c* have the same size and shape, i.e., a trapezoid shape defining the actuator unit 17, in plan view, i.e., when seen in a direction perpendicular to a face 17*a*1 of the piezoelectric layer 17*a* which is a face thereof on the other side of the piezoelectric layer 17*b*. That is, the actuator unit 17 is disposed so as to face and lay across the pressure chambers 16 and such that the piezoelectric layer 17*c* seals all the pressure chambers 16. In the present embodiment, the piezoelectric layers 17*a*, 17*b*, 17*c* have generally the same thickness of 15 μm.

A multiplicity of individual electrodes 18 are formed on the face 17*a*1 at positions respectively facing the pressure chambers 16. A common electrode 19 is formed between the piezoelectric layer 17*a* and the piezoelectric layer 17*b*. A metal layer 20 is formed between the piezoelectric layer 17*b* and the piezoelectric layer 17*c*. No electrodes are formed on a lower face of the piezoelectric layer 17*c*. The common electrode 19 is formed on an entire upper face of the piezoelectric layer 17*b*, and the metal layer 20 is formed on an entire upper face of the piezoelectric layer 17*c*. Each of these electrodes 18, 19 (except lands 18*c* which will be described below) and the metal layer 20 is formed of gold (Au) and has a thickness of about 1 μm. It is noted that the metal layer 20 is connected to the common electrode 19 via a through hole at a corner portion of the trapezoidal actuator unit 17 in plan view. The metal layer 20 acts, together with the common electrode 19, as a constant potential electrode for all the pressure chambers 16 corresponding to the actuator unit 17.

Like the pressure chambers 16, the individual electrodes 18 are arranged in matrix so as to form a plurality of rows and columns. As shown in FIG. 6B, each of the individual electrodes 18 is constituted by a main portion 18*a*, an extended portion 18*b*1, a dummy extended portion 18*b*2, and the land 18*c*. The main portion 18*a* has a generally rhombic shape and faces the corresponding pressure chamber 16 in its entirety. The extended portion 18*b*1 extends from one of acute portions of the main portion 18*a* in an X direction (as one example of an extending direction) such that a distal end of the extended portion 18*b*1 does not face the pressure chamber 16 in plan view. The land 18*c* is formed on the distal end of the extended portion 18*b*1 so as not to face the pressure chamber 16. The dummy extended portion 18*b*2 extends from the other of the acute portions of the main portion 18*a* in a Y direction (as one example of an opposite direction) such that a distal end of the extended portion 18*b*2 does not face the pressure chamber 16 in plan view like the extended portion 18*b*1. It is noted that the X direction and the Y direction are parallel and opposite to each other.

The main portion 18*a* is geometrically similar to and one-size smaller than the pressure chamber 16 and included within the pressure chamber 16 in plan view. As shown in FIG. 6B, the main portion 18*a* is elongated in the X direction. When the actuator unit 17 and the channel unit 12 are arranged such that barycenters of the main portion 18*a* and the pressure chamber 16 coincide with each other, a distance D (about 64 μm) between an edge of the main portion 18*a* and a wall defining the pressure chamber 16 is constant over the edge of the main portion 18*a* except areas in which the extended portion 18*b*1 and the dummy extended portion 18*b*2 extend.

Each of the extended portion 18*b*1 and the dummy extended portion 18*b*2 has a generally rectangular shape. A width Wb1 (about 100 μm) of the extended portion 18*b*1 in a direction perpendicular to the X direction is the same as a width Wb2 of the dummy extended portion 18*b*2 and shorter than a width Wa of the main portion 18*a*. A length Lb2 of the dummy extended portion 18*b*2 in the Y direction is about 80 μm.

The land 18*c* is formed of a conductive material such as silver palladium (AgPd), gold (Au), and silver (Ag). In the present embodiment, the land 18*c* is formed of the silver palladium (AgPd). The land 18*c* has a circular cylindrical shape having a diameter of about 130 μm. A distal end face (an upper face) of the land 18*c* is located at a position higher than the face 17*a*1 by about 10 μm. The land 18*c* is connected to a terminal of the FPC 50 via a bump, not shown, formed on the upper face of the land 18*c*.

The piezoelectric layer 17*a* includes active portions each interposed by a corresponding one of the individual electrodes 18 and the common electrode 19. When an electric field is applied to each active portion from an external device, the active portion is displaced in at least one of vibration modes $d_{31}$, $d_{33}$, $d_{15}$ (in $d_{31}$ in the present embodiment). Each of the piezoelectric layers 17*b*, 17*c* has non-active portions each located at a position facing a corresponding one of the active portions. The non-active portion is not voluntarily displaced even when the electric field is applied from the external device. That is, the actuator unit 17 has a piezoelectric actuator of a unimorph type in which one active portion and two non-active portions are stacked on one another for each pressure chamber 16. The piezoelectric actuators can be deformed independently of each other. When a drive voltage is applied to the lands 18*c* from the FPCs 50, the piezoelectric actuators are selectively deformed, thereby changing volume(s) of corresponding one or ones of the pressure chambers 16. As a result, an energy is applied to the ink in the pressure chamber(s) 16, and thereby an ink droplet is ejected from each of the corresponding ejection opening(s) 14*a*.

As shown in FIG. 7, on the face 17*a*1, the individual electrodes 18 having the extended portions 18*b*1 extending in opposite directions are alternately arranged in the main scanning direction. In the case of the individual electrode 18 indicated by "I" in FIG. 7 and the individual electrode 18 indicated by "II" in FIG. 7, a direction in which the extended portion 18*b*1 of the individual electrode 18 indicated by "I" extends is an upward direction in FIG. 7, and a direction in which the extended portion 18*b*1 of the individual electrode 18 indicated by "II" extends is a downward direction in FIG. 7.

In addition to the lands 18*c* of the respective individual electrodes 18, dummy lands 18*d* and common-electrode lands 18*e* are formed on the face 17*a*1. Each of the dummy lands 18*d* and the common-electrode lands 18*e* is formed of the same material as that of the land 18*c* and has the same shape and size as those of the land 18*c*. A bump, not shown, is formed on a distal end face of each of the dummy lands 18*d* and the common-electrode lands 18*e*. Each of the dummy lands 18*d* is disposed so as to be symmetrical with a corresponding one of the lands 18*c* with respect to a barycenter of a corresponding one of the main portions 18*a*, and the dummy lands 18*d* does not face any of the pressure chambers 16. That is, each of the dummy lands 18*d* is located on a downstream side of the dummy extended portion 18*b*2 in the direction in which the dummy extended portion 18*b*2 extends (i.e., the Y direction). Each dummy land 18*d* is electrically insulated from the corresponding individual electrode 18 and distant from a distal end of the corresponding dummy extended portion 18*b*2. As shown in FIG. 3, the common-electrode lands 18*e* are disposed on the face 17*a*1 at areas corresponding to upper and lower bases of the trapezoid shape of each actuator unit 17. Each of the common-electrode lands 18*e* is connected to a corresponding one of the FPCs 50 via a bump so as to be always kept at ground potential. It is noted that each common-electrode land 18*e* and the common electrode 19 are connected via a through hole extending through the piezoelectric layer 17*a*.

As shown in FIG. 7, each main portion 18*a* is surrounded by three lands 18*c* and three dummy lands 18*d*. In other words, each main portion 18*a* is disposed at a center of a hexagon whose vertexes are respectively constituted by three lands 18*c* and three dummy lands 18*d*. Each land 18*c*, 18*d* does not face the pressure chamber 16 and the same height from the face 17*a*1. According to this construction, in each of a case where the actuator unit 17 is fixed to the channel unit 12 and a case where the FPC 50 is fixed to the actuator unit 17, a pressing force is uniformly applied to the lands 18*c*, 18*d*, enabling uniform fixation over the entire actuator unit 17.

As described above, each of the heads 10 as the present embodiment includes the individual electrodes 18 whose directions in which the extended portions 18*b*1 extend are opposite to each other (see FIG. 7) among the plurality of the individual electrodes 18 on the piezoelectric layer 17*a*. In this construction, even where the individual electrodes 18 have been moved or misaligned in the X direction or the opposite direction thereto (i.e., in the Y direction) relatively to the pressure chamber 16, since the dummy extended portions 18*b*2 are provided as shown in FIG. 6B, large differences are not caused in a volume decrease rate of the active portions (eventually in ink ejection properties of the corresponding ejection opening 14*a*) among the individual electrodes 18 whose directions in which the extended portions 18*b*1 extend are opposite to each other. Accordingly, it is possible to prevent a deterioration of a recording quality.

Further, the width Wb1 of the extended portion 18*b*1 is shorter than the width Wa of the main portion 18*a*. Accordingly, it is possible to prevent a structural cross talk which is a phenomenon that the displacement of the active portion corresponding to the individual electrode 18 affects another active portion(s) adjacent thereto.

Further, the width Wb2 of the dummy extended portion 18*b*2 is shorter than the width Wa of the main portion 18*a*. This also achieves an effect for preventing the structural cross talk.

Further, the width Wb1 of the extended portion 18*b*1 and the width Wb2 of the dummy extended portion 18*b*2 are equal to each other. Accordingly, it is possible to decrease a difference in the volume decrease rate of the active portion between a case where the individual electrode 18 has been misaligned in the X direction and a case where the individual electrode 18 has been misaligned in the Y direction.

Further, the main portion 18*a* has a shape similar to that of the pressure chamber 16, thereby efficiently changing a volume (capacity) of the pressure chamber 16. Further, the main portion 18*a* is smaller in size than the pressure chamber 16, thereby achieving the effect for preventing the structural cross talk.

Further, each of the main portion 18*a* and the pressure chamber 16 is elongated in the X direction in plan view. Accordingly, even where the individual electrodes 18 have been misaligned in the X direction or the Y direction, it is possible to suppress a variation of the volume decrease rate of the active portions. Further, the above-described construction allows high-density or high-populated arrangement of the pressure chambers 16 and the individual electrodes 18. Further, a pressure wave propagated in the pressure chamber 16 along its longitudinal direction can be used to efficiently change the volume of the pressure chamber 16.

Further, the extended portion 18*b*1 and the dummy extended portion 18*b*2 extend respectively from opposite end portions of the main portion 18*a* in its longitudinal direction (in the above-described embodiment, the two acute portions of the main portion 18*a* having the rhombic shape). As a result, the individual electrodes 18 can be arranged in higher density.

Further, the land 18*c* is disposed at the position not facing the pressure chamber 16 in plan view. Accordingly, a force applied to the land 18*c* when the land 18*c* and the terminal of the FPC 50 are bonded to each other is transmitted to a portion of the laminar body constituted by the piezoelectric layers 17*a*, 17*b*, 17*c*, which portion does not face the pressure chamber 16. As a result, it is possible to prevent a portion of the laminar body which faces the pressure chamber 16 from being broken.

Further, as shown in FIG. 7, the dummy lands 18*d* are formed on the face 17*a*1. As a result, when the land 18*c* and the terminal of the FPC 50 are bonded to each other, the force is applied not only to the land 18*c* but also to the dummy land 18*d*. Accordingly, the force is distributed, thereby making it possible to reliably prevent the breakage of the laminar body.

Further, the dummy land 18*d* is distant from the dummy extended portion 18*b*2. As a result, when compared to a case where the dummy land 18*d* is connected to the dummy extended portion 18*b*2, the structural cross talk is suppressed.

In addition, the dummy land 18*d* is disposed so as to be symmetric with the land 18*c* with respect to the barycenter of the main portion 18*a*. As a result, the force is uniformly distributed, thereby making it possible to prevent the breakage of the laminar body more reliably.

Further, the dummy extended portion 18*b*2 extends to a position not facing the pressure chamber 16 in plan view (see FIG. 6B). As a result, even where the individual electrode 18 has been misaligned in the X direction, it is possible to suppress a reduction in the volume of the active portion.

Further, as shown in FIG. 7, the individual electrodes 18 having the extended portions 18*b*1 extending in opposite directions are alternately arranged in the main scanning direction on the face 17*a*1. In other words, first individual electrodes and second individual electrodes each having the extended portion 18*b*1 whose extending direction is opposite to that of the extended portion 18*b*1 of each of the first individual electrodes are alternately arranged in the main scanning direction. Since the lands 18*c* are arranged in balance, the terminals of the FPCs 50 can also be arranged in balance. As a result, when the land 18*c* and the terminal of the FPC 50 are bonded to each other, it is possible to reliably prevent the breakage of the laminar body owing to the force applied to the land 18*c*.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

Each of the actuator units may include any number of the piezoelectric layers.

Each of the lands and the dummy lands may have any shape, size, position, and the like. For example, the planar shape of each of the lands and the dummy lands may be various shapes such as an oval shape or a polygon, e.g., a triangle, instead of a circle. Each pair of the land and the dummy land may be disposed at a position facing the corresponding pressure chamber in a direction perpendicular to the face of the piezoelectric layer. The dummy lands and the common-electrode lands may not be formed on the face of the piezoelectric layer.

Each of the main portions and the common electrodes may also have any shape, size, number, position, and the like. For example, each main portion may have a size larger than the corresponding pressure chamber and may have a size not similar to the corresponding pressure chambers. Further, a single common electrode may be provided for each actuator unit.

A planar shape of each of the main portions and the pressure chambers is not limited to the elongated shape elongated in a direction in which the corresponding extended portion extends. The planar shape is limited to the rhombic shape and may be an oval shape, a rectangular shape, a circle, a square, or the like. The main portions (and the pressure chambers) are not limited to be arranged in matrix in plan view and may be arranged in a row in one direction (e.g., in the main scanning direction).

At least one of the extended portion and the dummy extended portion does not need to extend to the position not facing the corresponding pressure chamber in the direction perpendicular to the face of the piezoelectric layer. For example, where each dummy extended portion entirely faces the corresponding pressure chamber in plan view, the distance between the edge of the main portion and the wall defining the pressure chamber is constant except the extended portion and become narrower in the dummy extended portion in a direction opposite to the direction in which the extended portion extends. Also in this case, the structural cross talk can be reduced. Further, each of the extended portions and the dummy extended portions has any width and length (size). For example, a width of each extended portion and a width of each dummy extended portion may be different from each other. Further, each dummy extended portion may be connected to the corresponding dummy land.

Portions of the main portion from which the extended portion and the dummy extended portion extend are not particularly limited. For example, in FIG. 6B, the extended portion and the dummy extended portion may respectively extend from opposite end portions of the main portion 18*a* in a widthwise direction thereof (two obtuse portions of the main portion 18*a*) or from opposite sides of the rhombic shape of the main portion 18*a*. In each of these cases, it is possible to suppress the deterioration of the recording quality in the case where the individual electrode has been misaligned in the direction in which the extended portion extends or in the direction opposite thereto.

The individual electrodes may not be alternately arranged in one direction along the face of the piezoelectric layer as long as individual electrodes having the extended portions extending in opposite directions are provided on the face.

The liquid ejection head according to the present invention is not limited to the printer and may be applied to liquid ejection apparatuses such as a facsimile machine and a copying machine. Further, the number of the liquid ejection heads applied to the liquid ejection apparatus is not limited to four and may be the number equal to or larger than one. Each liquid ejection head is not limited to the line type and may be a serial type. Further, each liquid ejection head according to the present invention may eject liquid other than the ink.

What is claimed is:

1. A liquid ejection head comprising:

a channel unit having a plurality of pressure chambers, a plurality of ejection openings, and a plurality of liquid channels formed therein, the liquid channels respectively extending from the pressure chambers to the ejection openings; and an actuator unit including a piezoelectric layer and a plurality of individual electrodes formed on a face of the piezoelectric layer, the actuator unit being configured to apply a drive voltage to the individual electrodes to change volumes of the respective pressure chambers respectively corresponding to the individual electrodes, wherein each of the individual electrodes includes:

a land to which the drive voltage is applied;

a main portion disposed such that an entire area thereof is opposite to a corresponding one of the pressure chambers in a direction perpendicular to the face of the piezoelectric layer;

an extended portion extending, in an extending direction in which the extended portion extends, from the main portion toward the land along the face of the piezoelectric layer so as to connect the main portion and the land to each other; and a dummy extended portion extending from the main portion along the face of the piezoelectric layer in an opposite direction opposite to the extending direction.

2. The liquid ejection head according to claim 1, wherein the land is disposed on the face of the piezoelectric layer at a position not opposed to any of the pressure chambers in the direction perpendicular to the face of the piezoelectric layer.

3. The liquid ejection head according to claim 1, wherein the dummy extended portion extends along the face of the piezoelectric layer in the opposite direction from the main portion to a position on the face of the piezoelectric layer, the position being not opposed to any of the pressure chambers in the direction perpendicular to the face of the piezoelectric layer.

4. The liquid ejection head according to claim 1, wherein a length of the extended portion in a direction perpendicular to the extending direction is shorter than a length of the main portion in the direction perpendicular to the extending direction as seen in the direction perpendicular to the face of the piezoelectric layer.

5. The liquid ejection head according to claim 1, wherein a length of the dummy extended portion in a direction perpendicular to the extending direction is shorter than a length of the main portion in the direction perpendicular to the extending direction as seen in the direction perpendicular to the face of the piezoelectric layer.

6. The liquid ejection head according to claim 1, wherein a length of the dummy extended portion in a direction perpendicular to the extending direction is generally the same as a length of the extended portion in the direction perpendicular to the extending direction as seen in the direction perpendicular to the face of the piezoelectric layer.

7. The liquid ejection head according to claim 1, wherein the main portion has a shape similar to that of the corresponding pressure chamber and has an area smaller than that of the corresponding pressure chamber, as seen in the direction perpendicular to the face of the piezoelectric layer.

8. The liquid ejection head according to claim 1, wherein each of respective lengths of the main portion and the corresponding pressure chamber in the extending direction is longer than each of respective lengths of the main portion and the corresponding pressure chamber in a direction perpendicular to the extending direction as seen in the direction perpendicular to the face of the piezoelectric layer.

9. The liquid ejection head according to claim 8, wherein the extended portion and the dummy extended portion extend respectively from opposite end portions of the main portion in a longitudinal direction thereof.

10. The liquid ejection head according to claim 1, further comprising a plurality of dummy lands respectively corresponding to the individual electrodes, wherein each of the dummy lands has a shape the same as that of the corresponding land, and wherein each of the dummy lands is distant from the corresponding dummy extended portion in a direction in which the dummy extended portion extends.

11. The liquid ejection head according to claim 10, wherein, when the actuator unit and the channel unit are arranged such that barycenters of the main portion and the corresponding pressure chamber coincide with each other as seen in the direction perpendicular to the face of the piezoelectric layer, the dummy land corresponding to the main portion is disposed on the face of the piezoelectric layer at a position not opposed to any of the pressure chambers and at a position at which the dummy land is symmetrical with the corresponding land with respect to the barycenter of the main portion.

12. The liquid ejection head according to claim 1, wherein the individual electrodes includes a plurality of first individual electrodes and a plurality of second individual electrodes each having the extended portion whose extending direction is opposite to that of the extended portion of each of the first individual electrodes, and wherein the first individual electrodes and the second individual electrodes are alternately arranged in a direction perpendicular to the extending direction.

* * * * *